US011335271B2

(12) United States Patent
Yamashita et al.

(10) Patent No.: US 11,335,271 B2
(45) Date of Patent: May 17, 2022

(54) PIXEL CIRCUIT, DRIVING METHOD, AND DISPLAY DEVICE

(71) Applicant: EverDisplay Optronics (Shanghai) Co., Ltd., Shanghai (CN)

(72) Inventors: Keitaro Yamashita, Shanghai (CN); Lina Xiao, Shanghai (CN)

(73) Assignee: EverDisplay Optronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 16/766,673

(22) PCT Filed: Jul. 17, 2018

(86) PCT No.: PCT/CN2018/095981
§ 371 (c)(1),
(2) Date: May 22, 2020

(87) PCT Pub. No.: WO2019/119790
PCT Pub. Date: Jun. 27, 2019

(65) Prior Publication Data

US 2020/0372862 A1 Nov. 26, 2020

(30) Foreign Application Priority Data

Dec. 20, 2017 (CN) ..... 201711385161.7

(51) Int. Cl.
*G09G 3/3283* (2016.01)
*G09G 3/3233* (2016.01)

(52) U.S. Cl.
CPC ..... *G09G 3/3283* (2013.01); *G09G 3/3233* (2013.01); *G09G 2300/0842* (2013.01); *G09G 2320/0247* (2013.01)

(58) Field of Classification Search
CPC .. G09G 3/3225; G09G 3/3283; G09G 3/3233; G09G 2300/0842;
(Continued)

(56) References Cited

U.S. PATENT DOCUMENTS 9,418,595 B2 8/2016 Tseng et al.
2003/0052614 A1 3/2003 Howard
(Continued)

FOREIGN PATENT DOCUMENTS

CN 104464643 A 3/2015
CN 106875894 A 6/2017
(Continued)

OTHER PUBLICATIONS

The ISR issued Oct. 18, 2018 by the WIPO.
The CN1OA issued Mar. 18, 2020 by the CNIPA.

*Primary Examiner* — Jimmy H Nguyen
(74) *Attorney, Agent, or Firm* — Qinghong Xu

(57) ABSTRACT

A pixel circuit, a driving method and a display device are provided. The pixel circuit includes: a data writing unit, a driving unit, a light emitting unit and an initialization unit. The initialization unit is configured to initialize a second node with an initialization voltage. The data writing unit is configured to set voltage of a first node to the voltage of a data signal and update voltage of the second node. The driving unit is configured to drive the light emitting unit to emit light according to a control signal. Due to the second node being initialized and compensated by the initialization unit, the storage capacitor leakage paths and the electric leakage of the storage capacitor during the light emitting stage are reduced, thus improving the quality of the displayed image.

8 Claims, 15 Drawing Sheets

(58) Field of Classification Search
CPC ... G09G 2300/0861; G09G 2300/0814; G09G 2300/0819; G09G 2300/0876; G09G 2320/0233; G09G 2320/029; G09G 2320/0247
USPC ..... 345/76, 531
See application file for complete search history.

(56) References Cited

U.S. PATENT DOCUMENTS

| | | | | |
|---|---|---|---|---|
| 2015/0170576 | A1* | 6/2015 | Bae | G09G 3/3266 345/205 |
| 2020/0302859 | A1* | 9/2020 | Wang | G09G 3/3233 |

FOREIGN PATENT DOCUMENTS

| | | | |
|---|---|---|---|
| CN | 107038992 | A | 8/2017 |
| CN | 107068045 | A | 8/2017 |
| CN | 107464526 | A | 12/2017 |

* cited by examiner

PIXEL CIRCUIT, DRIVING METHOD, AND DISPLAY DEVICE

CROSS-REFERENCE TO RELATED APPLICATIONS

This application is based upon PCT patent application No. PCT/CN2018/095981, filed on Jul. 17, 2018, which claims priority to Chinese Patent Application No. 201711385161.7, filed on Dec. 20, 2017, the entire contents of which are incorporated herein by reference.

TECHNICAL FIELD

The present disclosure relates generally to electronic display devices, and more particularly to a pixel circuit, a driving method, and a display device.

BACKGROUND

In a conventional pixel circuit, a thin film transistor is generally used to drive a light emitting diode (OLED) in a pixel circuit to emit light. Such thin film transistor is referred to as a driving transistor. The driving transistor is operated in the saturation mode because the current output from the driving transistor in the saturation mode is less sensitive to change in the source-drain voltage compared to that from the driving transistor in the linear region (active mode), and thus the driving transistor can enable the OLED with a more stable driving current. FIG. 1 shows a basic pixel circuit in the prior art. As shown in FIG. 1, the pixel circuit includes two driving transistors T11 and T12, and a capacitor C11. When the transistor T12 is turned on according to signal $S_n$, the data signal data is written to a node N1 to charge the capacitor C11. Meanwhile the driving transistor T11 is turned on and an OLED EL11 between a first power supply ELVDD and a second power supply ELVSS is driven by the driving transistor T11 to emit light. The value of the driving current can be calculated from Equation 1.

$$I_{EL} = \frac{1}{2}\mu C_{OX}\frac{W}{L}(V_{GS} + V_{TH})^2 \quad \text{(Equation 1)}$$

where μ refers to the carrier mobility, $C_{OX}$ refers to the unit-area capacitance of gate oxide, L refers to the channel length of the transistor T11, W refers to the gate width of the transistor T11, $V_{GS}$ refers to the gate-source voltage of the transistor T11, $V_{TH}$ refers to the threshold voltage of the transistor T11. It can be seen from Equation 1 that, the magnitude of the driving current is related to the threshold voltage of the transistor T11. However, due to the phenomenon of threshold voltage shift, the threshold voltage of the driving transistor T11 is not stable, resulting in shift of the driving current and uneven luminance of the OLEDs.

To solve the aforementioned problems, various circuits that eliminate the influence from the threshold voltage shift of the driving transistor and referred to as threshold compensation circuits are developed. FIG. 2 shows an existing threshold compensation circuit. As shown in FIG. 2, in an initialization stage, the node N1 is initialized when the transistor T1 is turned on in response to a signal Sn−1. In a data writing stage, a transistor T3 is turned on in response to a signal Sn, to compensate the voltage at node N. However, when the pixel circuit is in a light emitting stage, there are two leakage paths, Ioff1 and Ioff2, which are coupled to the node N1 shown as the dotted line in FIG. 2, making the leakage of storage capacitor Cs worse, and causing uneven display and flickering of the display device.

SUMMARY

The present disclosure provides a pixel circuit, a driving method and a display device to solve the abovementioned problems, namely the problems of uneven display and flickering of the display device.

In some embodiments, the present disclosure provides a pixel circuit including a data writing unit, a driving unit, electrically coupled to the data writing unit through a first node, an initialization unit, electrically coupled to the driving unit through a second and a third node respectively, and a light emitting unit, electrically coupled to the driving unit through the third node: wherein, the initialization unit is configured to receive an external first scan signal, an external second scan signal and an external initialization voltage; the initialization unit is configured to initialize the second node with the initialization voltage, in response to the first scan signal and the second scan signal; the data writing unit is configured to receive an external data signal and the first scan signal; the data writing unit is configured to set voltage of the first node to voltage of the data signal in response to the first scan signal and the data signal, and update voltage of the second node through the driving unit and the initialization unit; the driving unit is coupled to an external power supply and configured to receive an external first control signal; the driving unit is configured to generate a driving current, in response to the first control signal, to drive the light emitting unit to emit light; the value of the driving current depends on the voltage of the second node, voltage of the external power supply and the threshold voltage of driving transistors in the driving unit.

In some embodiments of the present disclosure, the initialization unit includes a first initialization transistor, including a first electrode electrically coupled to the driving unit through the second node, a second electrode electrically coupled to the driving unit and the light emitting unit respectively through the third node, and a gate electrode configured to receive the first scan signal; a second initialization transistor, including a first electrode electrically coupled to the second electrode of the first initialization transistor through the third node, a second electrode configured to receive the initialization voltage, and a gate electrode configured to receive the second scan signal; wherein, the first initialization transistor and the second initialization transistor are configured to set the voltage of the second node to the initialization voltage during an initialization stage: the first initialization transistor is further configured to update the voltage of the second node through the driving unit during a data writing stage.

In some embodiments, the data writing unit includes a data writing transistor T5 having a first electrode electrically coupled to the driving unit through the first node, a second electrode configured to receive the data signal and a gate electrode configured to receive the first scan signal.

In some embodiments, the light emitting unit includes a light emission control transistor, including a first electrode electrically coupled to the driving unit and the initialization unit through the third node, a second electrode, and a gate electrode configured to receive the first control signal, and an OLED, electrically coupled to the second electrode of the light emission control transistor.

In some embodiments, the initialization unit is electrically coupled to the OLED, and is further configured to initialize the OLED with the initialization voltage, in response to the first scan signal and the second scan signal.

In some embodiments, the driving unit includes a storage capacitor located between the first node and the second node, a driving transistor, including a first electrode coupled to the external power supply, a second electrode electrically coupled to the light emitting unit and the initialization unit respectively through the third node, and a gate electrode electrically coupled to the initialization unit and the storage capacitor, respectively, through the second node; a switching transistor, including a first electrode electrically coupled to the data writing unit and the storage capacitor through the first node respectively, a second electrode configured to receive the initialization voltage, and a gate electrode configured to receive the first control signal.

In some embodiments, the driving unit includes a storage capacitor, including one end coupled to the external power supply, and the other end electrically coupled, through the second node, to the initialization unit and the gate electrode of the driving transistor respectively; a driving transistor, including a first electrode electrically coupled to the data writing unit through the first node, and a second electrode electrically coupled, through the third node, to the light emitting unit and the initialization unit respectively; a switching transistor, including a first electrode electrically coupled to the external power supply, a second electrode electrically coupled to the first electrode of the driving transistor, and a gate electrode configured to receive the first control signal.

The present disclosure further provides a pixel circuit driving method, applied to the pixel circuit according to any one of the aforementioned embodiments, including: in an initialization stage, turning on the initialization unit in response to the first scan signal and the second scan signal, and initializing the second node by the initialization unit with the initialization voltage; in a data writing stage, writing data to the data writing unit in response to the first scan signal and the data signal, and the data writing unit setting the voltage of the first node to the voltage of the data signal; turning on the driving unit in response to the voltage of the first node and the voltage of the second node, and updating the voltage of the second node; in a light emission stage, turning on the driving unit and the light emitting unit in response to the first control signal, and the driving unit generating a driving current to drive the light emitting unit to emit light: wherein the value of the driving current depends on the voltage of the second node, the voltage of the external power supply and the threshold voltage of the driving transistor in the driving unit.

In some embodiments, in the initialization stage, the method further includes the initialization unit initializing the OLED of the light emitting unit with an initialization voltage.

The present disclosure further provides a display device, including any of the aforementioned pixel circuits.

In summary, the embodiments of the present disclosure provide a pixel circuit, a driving method, and a display device. The pixel circuit includes: a data writing unit, a driving unit, electrically coupled to the data writing unit through a first node, an initialization unit, electrically coupled to the driving unit through a second and a third node respectively, and a light emitting unit, electrically coupled to the driving unit through the third node; wherein, the initialization unit is configured to receive an external first scan signal, an external second scan signal and an external initialization voltage; the initialization unit is configured to initialize the second node with the initialization voltage, in response to the first scan signal and the second scan signal; the data writing unit is configured to receive an external data signal and the first scan signal; the data writing unit is configured to set the voltage of the first node to the voltage of the data signal in response to the first scan signal and the data signal, and update the voltage of the second node through the driving unit and the initialization unit; the driving unit is coupled to an external power supply and configured to receive an external first control signal; the driving unit is configured to generate a driving current, in response to the first control signal, to drive the light emitting unit to emit light; the value of the driving current depends on the voltage of the second node, the voltage of the external power supply and the threshold voltage of driving transistors in the driving unit. Due to the second node being initialized by the initialization unit and the voltage of the second node being compensated by the driving unit and the initialization unit, the initialization of the second node and voltage compensation are simultaneously performed through the initialization unit, thereby reducing the storage capacitor leakage paths, and the electric leakage of the storage capacitor during the light emitting stage, thus improving the quality of the displayed image.

BRIEF DESCRIPTION OF THE DRAWINGS

In order to more clearly illustrate technical solutions in the embodiments of the present disclosure, the drawings used in the description of the embodiments are briefly described below. Obviously, the drawings in the following description are merely some embodiments of the present disclosure. Those skilled in the art can also obtain other drawings based on these drawings without any creative labor.

DETAILED DESCRIPTION

To better illustrate the purpose of the present disclosure, technical proposal and advantages thereof, embodiments of the present disclosure will be described in detail with reference to the drawings. It should be readily understood that both the embodiments and the drawings are explanatory for the present disclosure only, and are not intended as a limitation on the scope of the present disclosure.

Figure 1:
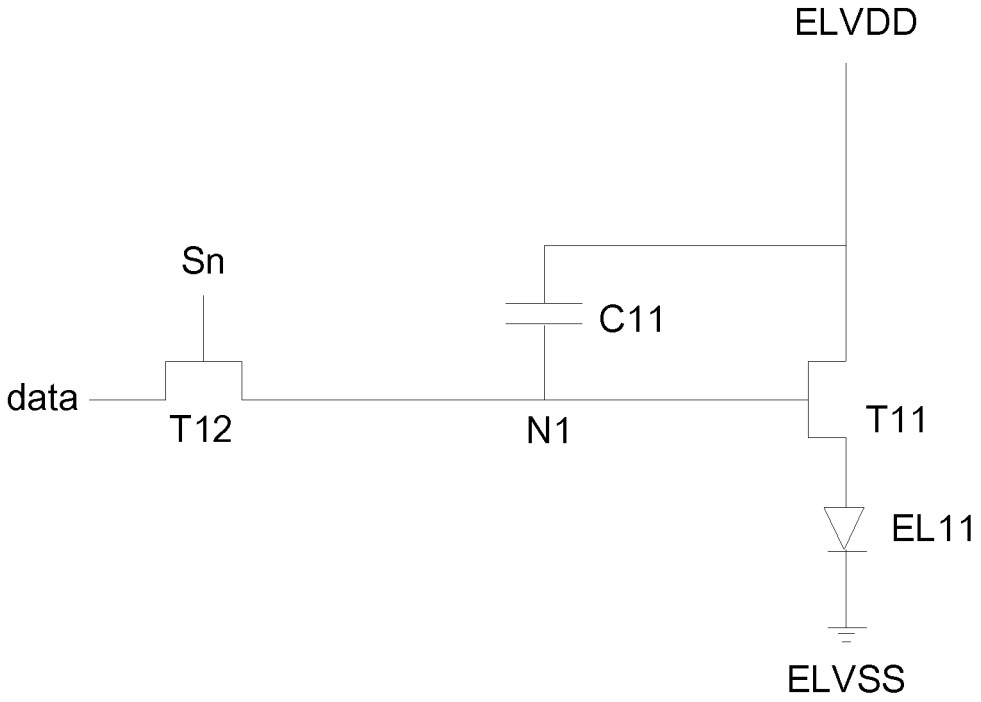
FIG. 1 (prior art)
FIG. 1 is a circuit diagram of an existing basic pixel circuit.
Figure 2:
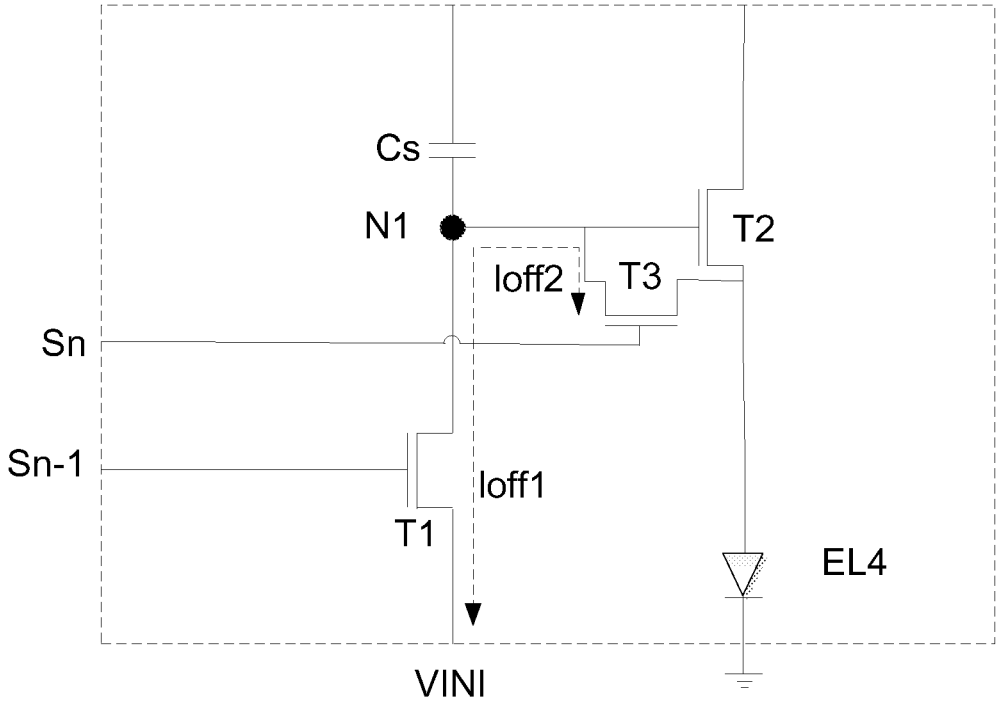
FIG. 2 (prior art)
FIG. 2 is a circuit diagram of an existing threshold compensation circuit.
Figure 3:
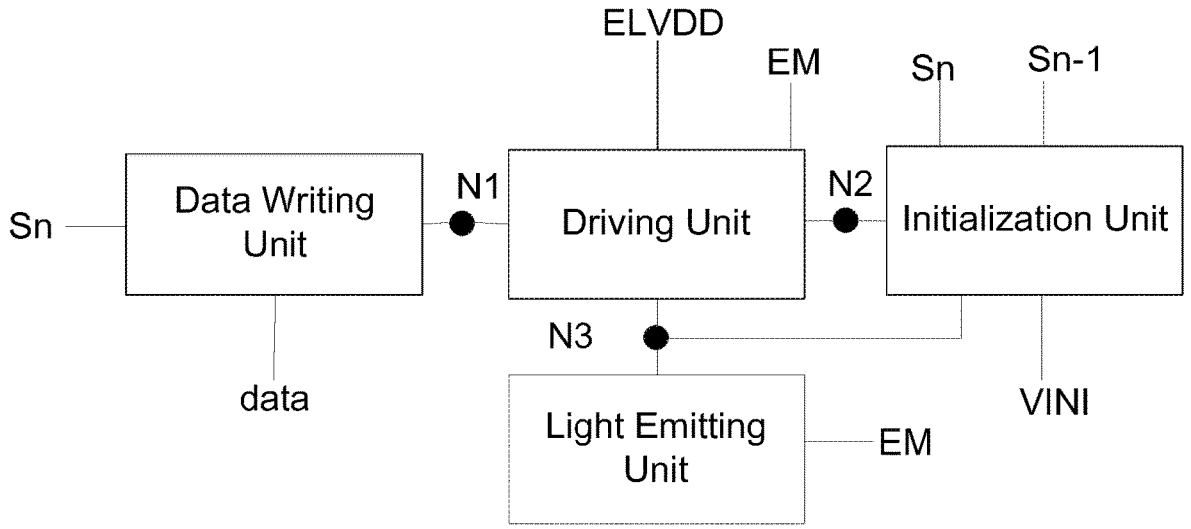
FIG. 3 is a schematic diagram of a pixel circuit according to an embodiment.

FIG. 3 is a schematic diagram of a pixel circuit according to an embodiment of the present disclosure. As shown in FIG. 3, the pixel circuit includes a data writing unit, a driving unit, a light emitting unit, and an initialization unit. The data writing unit is electrically coupled to the driving unit through a first node N1. The driving unit is electrically coupled to the initialization unit through a second node N2. The driving unit is electrically coupled to the light emitting unit and the initialization unit through a third node N3, respectively. The initialization unit is configured to receive an external first scan signal Sn, an external second scan signal Sn−1, and an initialization voltage VINI. The initialization unit is configured to initialize the second node N2 with the initialization voltage VINI in response to the first scan signal $S_n$ and the second scan signal Sn−1. The data writing unit is configured to receive an external data signal data and the first scan signal $S_n$: the data writing unit, in response to the first scan signal $S_n$ and the data signal data, sets voltage of the first node N1 to the voltage of the data signal data, and updates voltage of the second node N2 through the driving unit and the initialization unit. The driving unit is configured to receive an external power supply ELVDD and a first control signal EM. The driving unit is configured to generate a driving current, according to the first control signal EM, to drive the light emitting unit to emit light. The value of the driving current depends on the voltage of the second node N2, the external power supply ELVDD and the threshold voltage of the driving transistor of the driving unit. In specific implementation, the internal structures of the data writing unit, driving unit, light emitting unit, and initialization unit are not limited in the embodiments of the present disclosure. Instead, the pixel circuits capable of realizing the functions and the interaction relationships of the data writing unit, the driving unit, the light emitting unit, and the initialization unit in the embodiment above, should all be included in the embodiments of the present disclosure.

Figure 4:
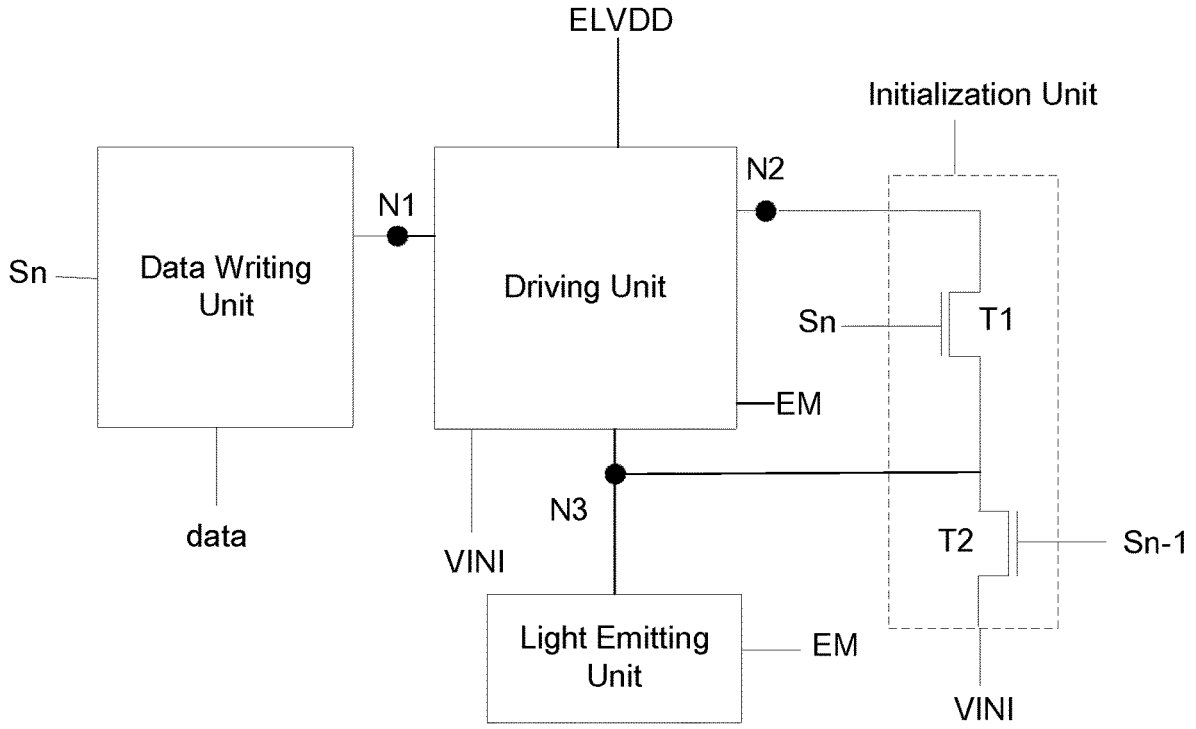
FIG. 4 is a schematic diagram of an initialization unit according to an embodiment of the present disclosure.

FIG. 4 illustrates a possible implementation of the initialization unit according to an embodiment of the present disclosure. As shown in FIG. 4, the initialization unit includes a first initialization transistor T1 and a second initialization transistor T2; a first electrode of the first initialization transistor T1 is electrically coupled to the driving unit through the second node N2, and a second electrode of the first initialization transistor T1 is electrically coupled to the first electrode of the second initialization transistor T2, the driving unit and the light emitting unit through the third node N3, respectively. The gate electrode of the first initialization transistor T1 is configured to receive the first scan signal Sn. The second electrode of the second initialization transistor T2 is configured to receive the initialization voltage VINI, and the gate electrode of the second initialization transistor T2 is configured to receive the second scan signal Sn−1. The first initialization transistor T1 and the second initialization transistor T2 are configured to set the voltage of the second node N2 to the initialization voltage VINI during an initialization stage. The first initialization transistor T1 further updates the voltage of the second node N2 through the driving unit during a data writing stage. It should be noted that each of the first initialization transistor T1 and the second initialization transistor T2 in the initialization unit could either be a single-gate transistor or a double-gate transistor.

Figure 5:
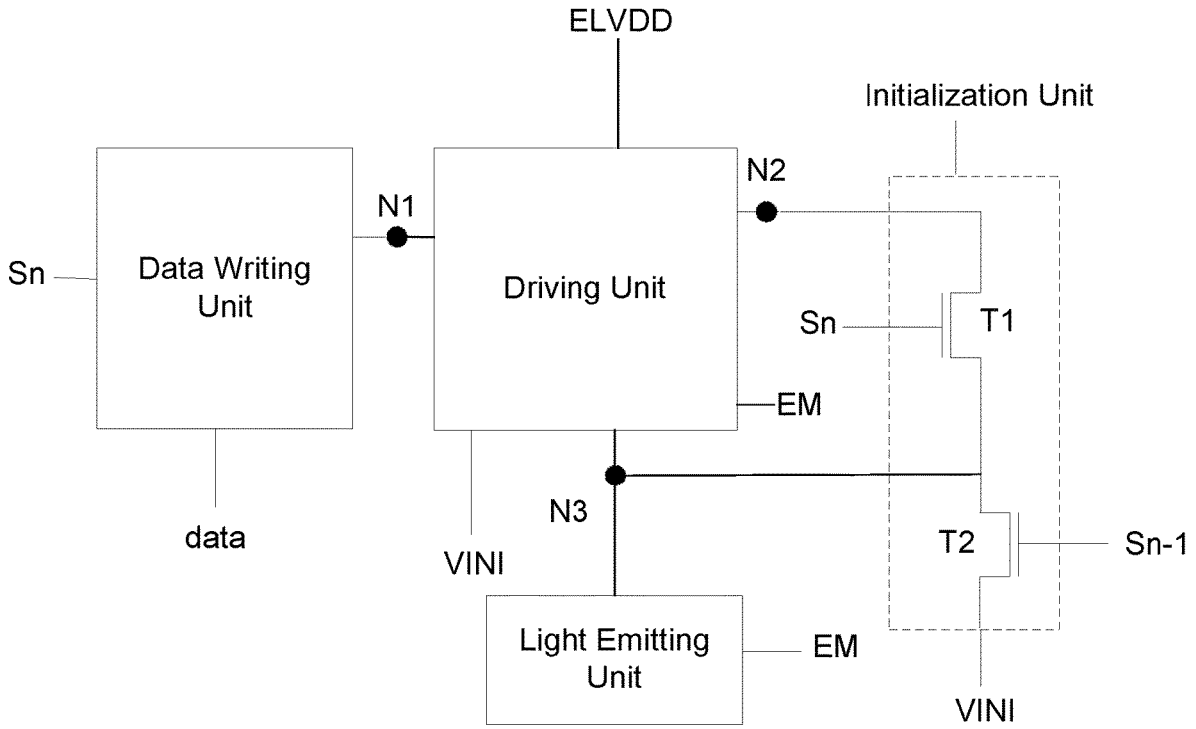
FIG. 5 is a schematic diagram of an initialization unit according to an embodiment of the present disclosure.

FIG. 5 illustrates a possible implementation of the initialization unit according to an embodiment of the present disclosure. As shown in FIG. 5, the initialization unit includes a first initialization transistor T1 and a second initialization transistor T2 and a third initialization transistor T7. Each of the first initialization transistor T1, the second initialization transistor T2 and the third initialization transistor T7 in the initialization unit could either be a single-gate transistor or a double-gate transistor. The first electrode of the first initialization transistor T1 is electrically coupled to the driving unit through the second node N2, and the second electrode of the first initialization transistor T1 is electrically coupled to the first electrode of the third initialization transistor T7, the driving unit and the light emitting unit through the third node N3, respectively. The gate electrode of the first initialization transistor T1 is configured to receive the external first scan signal Sn. The second electrode of the third initialization transistor T7 is electrically coupled to the first electrode of the second initialization transistor T2. The gate electrode of the third initialization transistor T7 is configured to receive the external first scan signal Sn. The second electrode of the second initialization transistor T2 is configured to receive the external initialization voltage VINI. The gate electrode of the second initialization transistor T2 is configured to receive the external second scan signal Sn−1. The first initialization transistor T1, the second initialization transistor T2, and the third initialization transistor T7 are configured to set the voltage of the second node N2 to the initialization voltage VINI during the initialization stage. The first initialization transistor T1 further updates the voltage of the second node N2 through the driving unit during the data writing stage. The third initialization transistor T7 is further configured to reduce the electric leakage of the storage capacitor, and serves as a bridge between the first initialization transistor T1 and the second initialization transistor T2. Without additional manufacturing processes, the per-unit area of the display device is economized and thereby improving pixel resolution (Pixels Per Inch or PPI for short).

Figure 6:
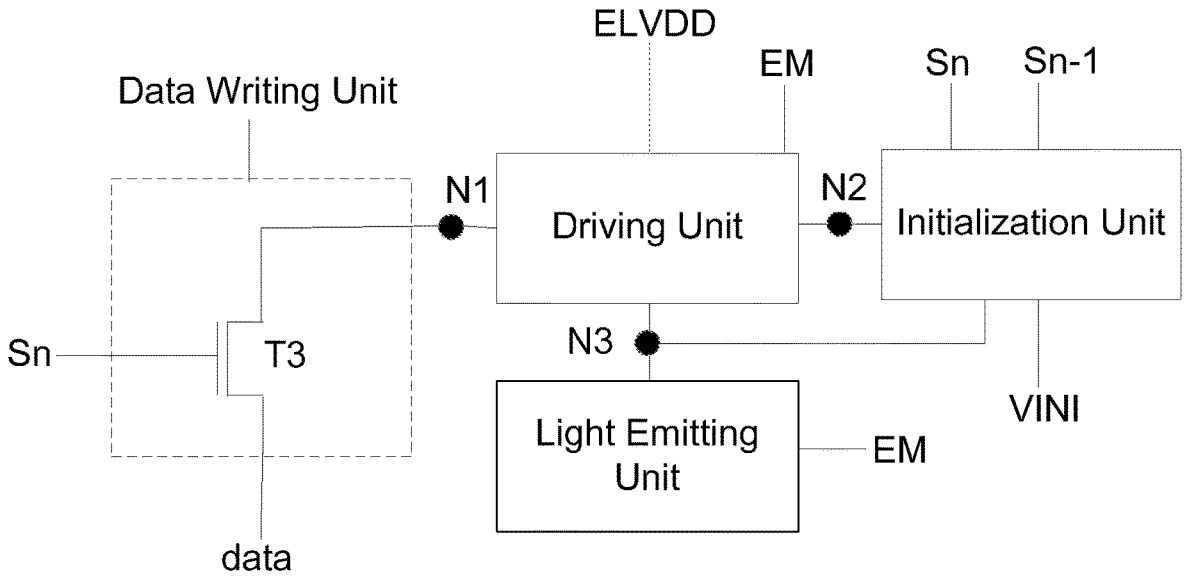
FIG. 6 is a schematic diagram of a data writing unit according to an embodiment of the present disclosure.

FIG. 6 illustrates a possible implementation of the data writing unit according to an embodiment of the present disclosure. As shown in FIG. 6, the data writing unit includes a data writing transistor T3. The first electrode of the data writing transistor T3 is electrically coupled to the driving unit through the first node N1, the second electrode of the data writing transistor T3 is configured to receive the data signal data, and the gate electrode of the data writing transistor T3 is configured to receive the first scan signal Sn.

Figure 7:
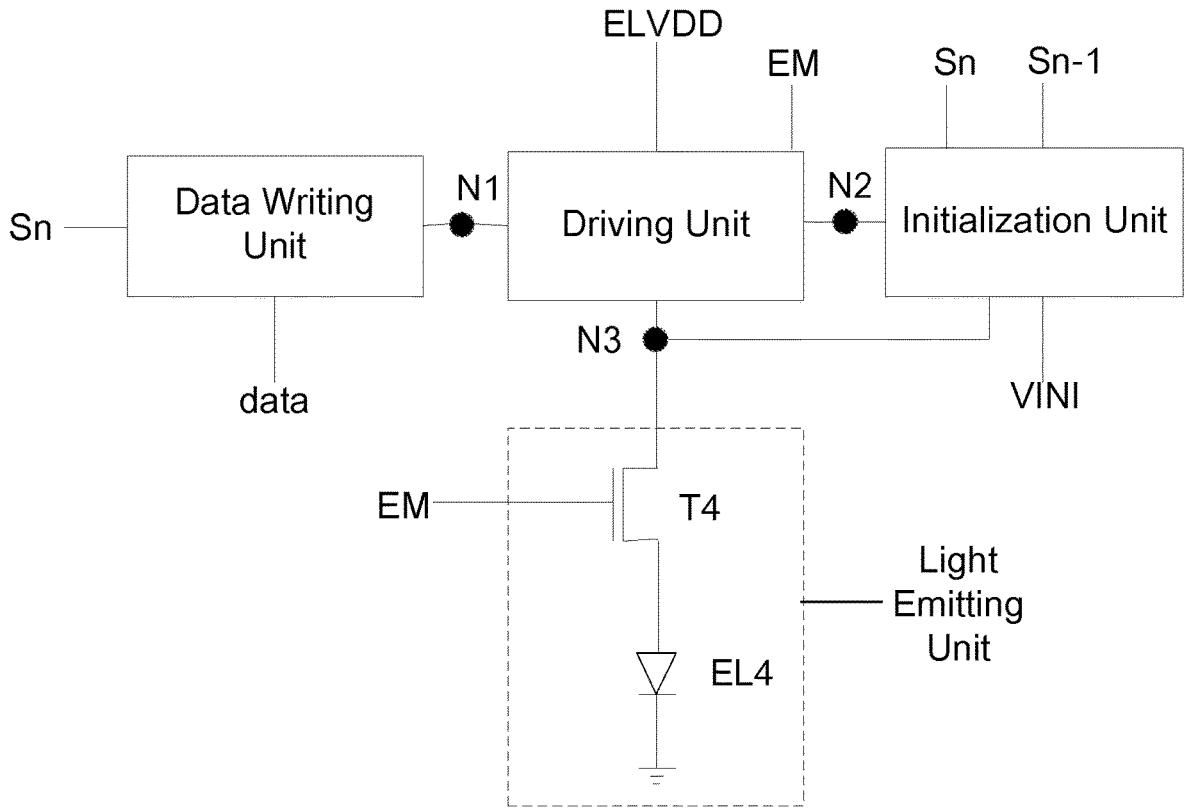
FIG. 7 is a schematic diagram of a light emitting unit according to an embodiment of the present disclosure.

FIG. 7 illustrates a possible implementation of the light emitting unit according to an embodiment of the present disclosure. As shown in FIG. 7, the light emitting unit includes a light emitting control transistor T4 and an OLED EL4. The first electrode of the light emission control transistor T4 is electrically coupled to the driving unit and the initialization unit through the third node N3, the second electrode of the light emission control transistor T4 is electrically coupled to the OLED EL4, and the gate electrode of the light emission control transistor T4 is configured to receive the external first control signal EM.

Figure 8:
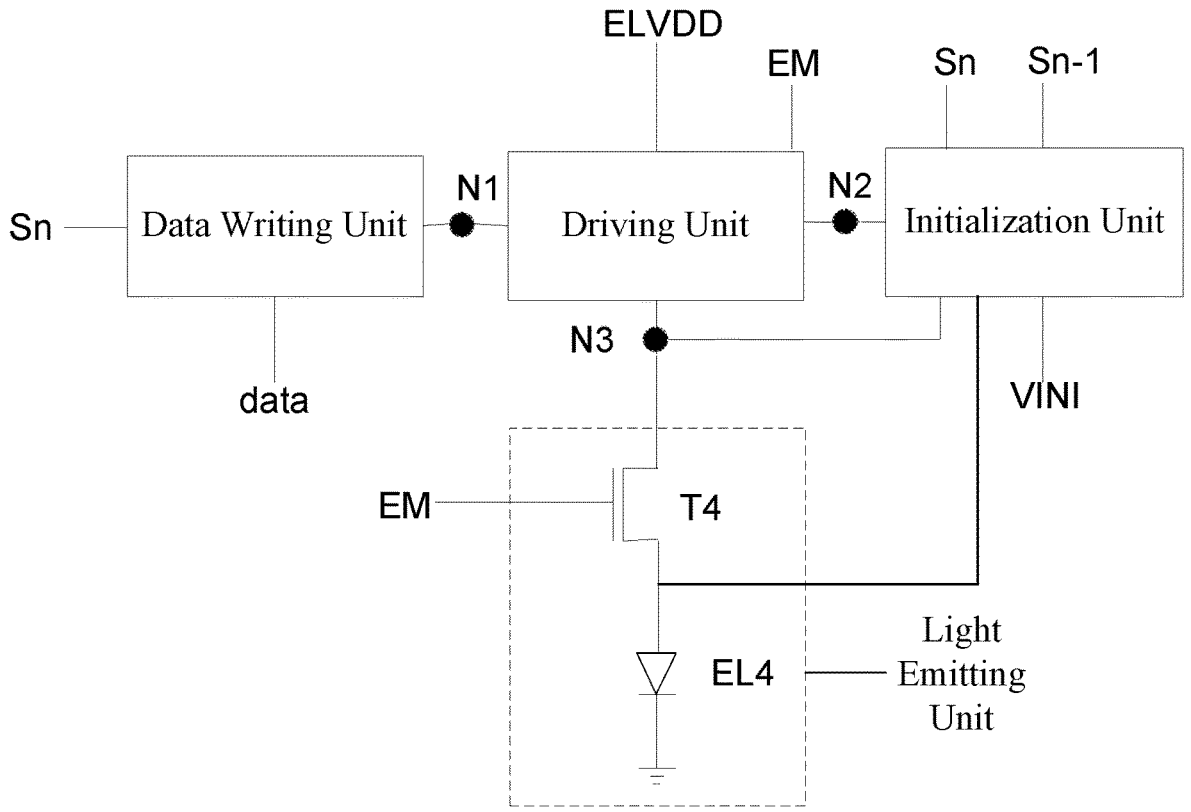
FIG. 8 is a schematic diagram of a light emitting unit according to an embodiment of the present disclosure.

FIG. 8 illustrates a possible implementation of the light emitting unit according to an embodiment of the present disclosure. As shown in FIG. 8, the light emitting unit includes a light emitting control transistor T4 and an OLED EL4. The first electrode of the light emission control transistor T4 is electrically coupled to the driving unit and the initialization unit through the third node N3, the second electrode of the light emission control transistor T4 is electrically coupled to the OLED EL4 and the initialization unit, and the gate electrode of the light emission control transistor T4 is configured to receive the first control signal EM. The initialization unit is configured to initialize the OLED EL4 with the initialization voltage VINI in response to the first scan signal Sn and the second scan signal Sn−1.

Figure 9:
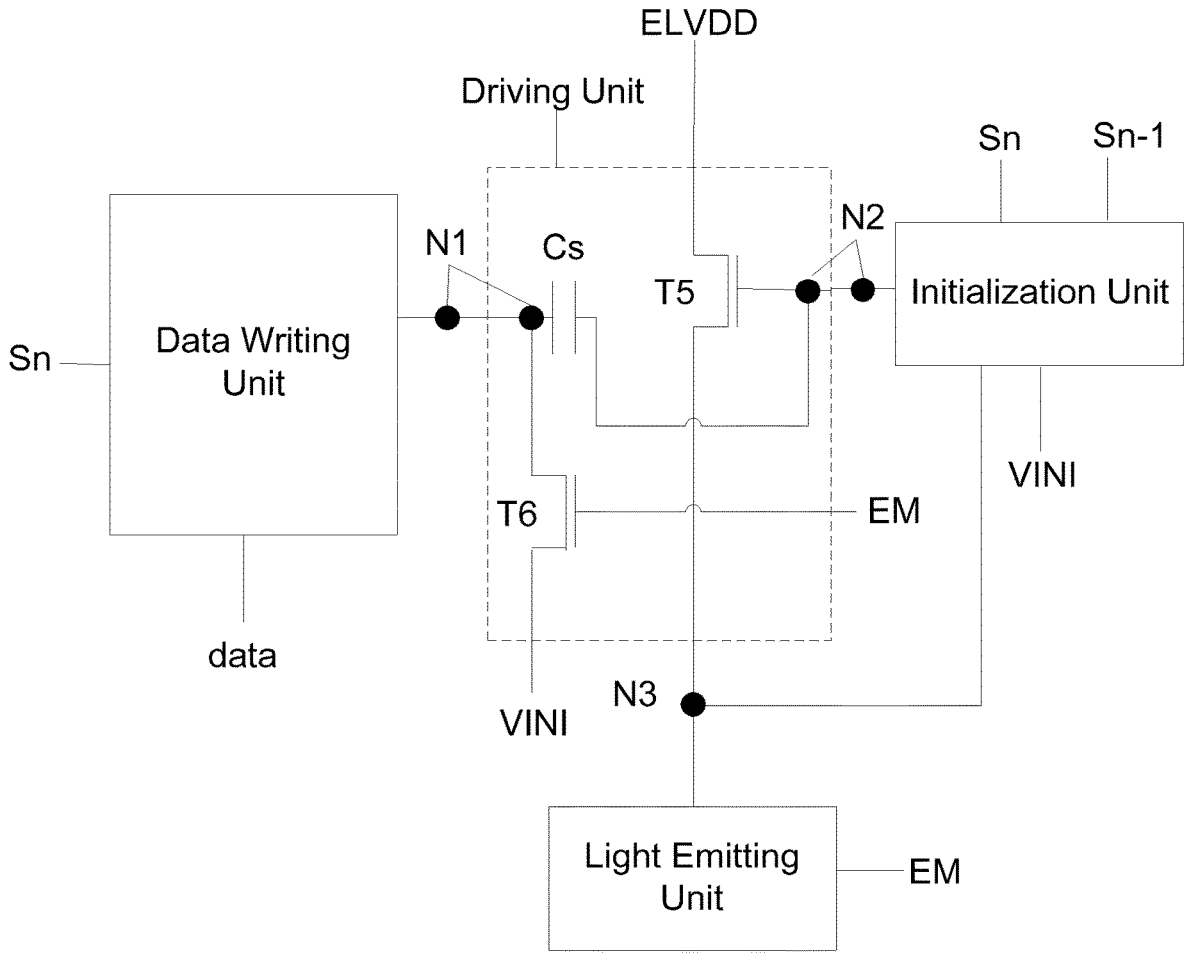
FIG. 9 is a schematic diagram of a driving unit according to an embodiment of the present disclosure.

FIG. 9 illustrates a possible implementation of the driving unit according to an embodiment of the present disclosure. As shown in FIG. 9, the driving unit includes a storage capacitor Cs, a driving transistor T5, and a switching transistor T6. The storage capacitor Cs is located between the first node N1 and the second node N2. The first electrode of the driving transistor T5 is electrically coupled to the external power supply ELVDD, the gate electrode of the driving transistor T5 is electrically coupled to the initialization unit and the storage capacitor Cs through the second node N2, and the second electrode of the driving transistor T5 is electrically coupled to the light emitting unit and the initialization unit through the third node N3. The first electrode of the switching transistor T6 is electrically coupled to the data writing unit and the storage capacitor Cs through the first node N1, the second electrode of the switching transistor T6 is configured to receive the external initialization voltage VINI, and the gate electrode of the switching transistor T6 is configured to receive the first control signal EM.

Figure 10:
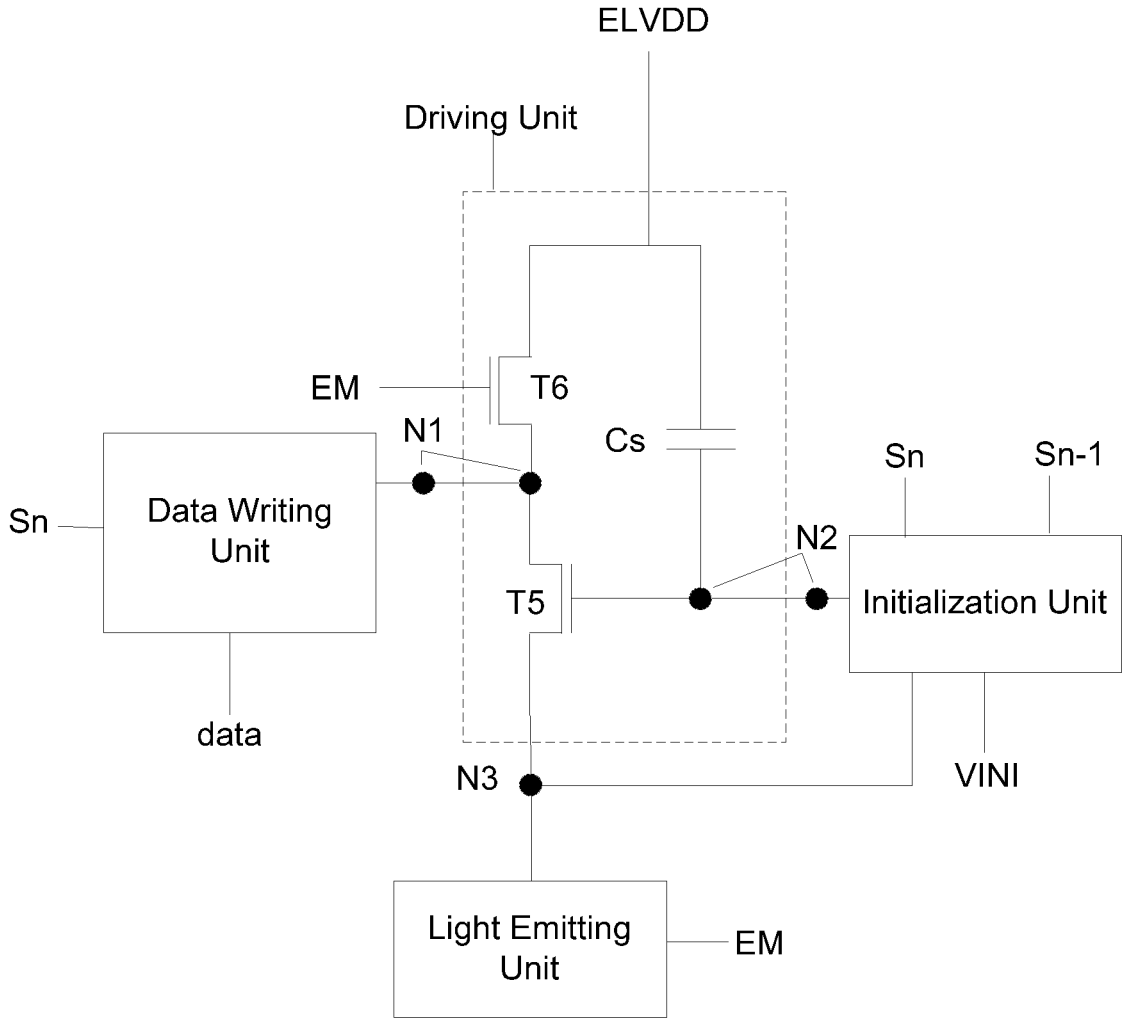
FIG. 10 is a schematic diagram of a driving unit according to an embodiment of the present disclosure.

FIG. 10 illustrates a possible implementation of the driving unit according to an embodiment of the present disclosure. As shown in FIG. 10, the driving unit includes a storage capacitor Cs, a driving transistor T5, and a switching transistor T6. One end of the storage capacitor Cs is electrically coupled to an external power supply ELVDD, and the other end of the storage capacitor Cs is electrically coupled to the initialization unit and the gate electrode of the driving transistor T5 through a second node N2, respectively. The first electrode of the driving transistor T5 is electrically coupled to the data writing unit and the second electrode of the switching transistor T6 through a first node N1, respectively, and the second electrode of the driving transistor T5 is electrically coupled to the light emitting unit and the initialization unit through a third node N3. The first electrode of the switching transistor T6 is configured to receive the external power supply ELVDD, and the gate electrode of the switching transistor T6 is configured to receive the first control signal EM.

In summary, some embodiments of the present disclosure provide a pixel circuit, a driving method, and a display device, with the pixel circuit including: a data writing unit, a driving unit, a light emitting unit, and an initialization unit; the data writing unit is electrically coupled to the driving unit through a first node; the driving unit is electrically coupled to the initialization unit through a second node: the driving unit is electrically coupled to the light emitting unit and the initialization unit through a third node; the initialization unit is configured to receive an external first scan signal, an external second scan signal and an initialization voltage; the initialization unit is configured to initialize the second node with the initialization voltage in response to the first scan signal and the second scan signal; the data writing unit is configured to receive the external data signal and the external first scan signal, the data writing unit is configured to set the voltage of the first node to the voltage of the data signal in response to the first scan signal and the data signal, and thus update the voltage of the second node through the driving unit and the initialization unit; the driving unit is configured to receive an external power supply and a first control signal: the driving unit is configured to generate a driving current, in response to the first control signal, to drive the light emitting unit to emit light; the value of the driving current depends on the voltage of the second node, the external power supply and the threshold voltage of the driving transistor of the driving unit. Due to the second node being initialized by the initialization unit and the voltage of the second node being compensated by the driving unit and the initialization unit, effectively the initialization and voltage compensation of the second node are simultaneously performed through the initialization unit, thereby reducing the leakage paths of the storage capacitor during the light emission stage, and improving the quality of the displayed image.

Figure 11:
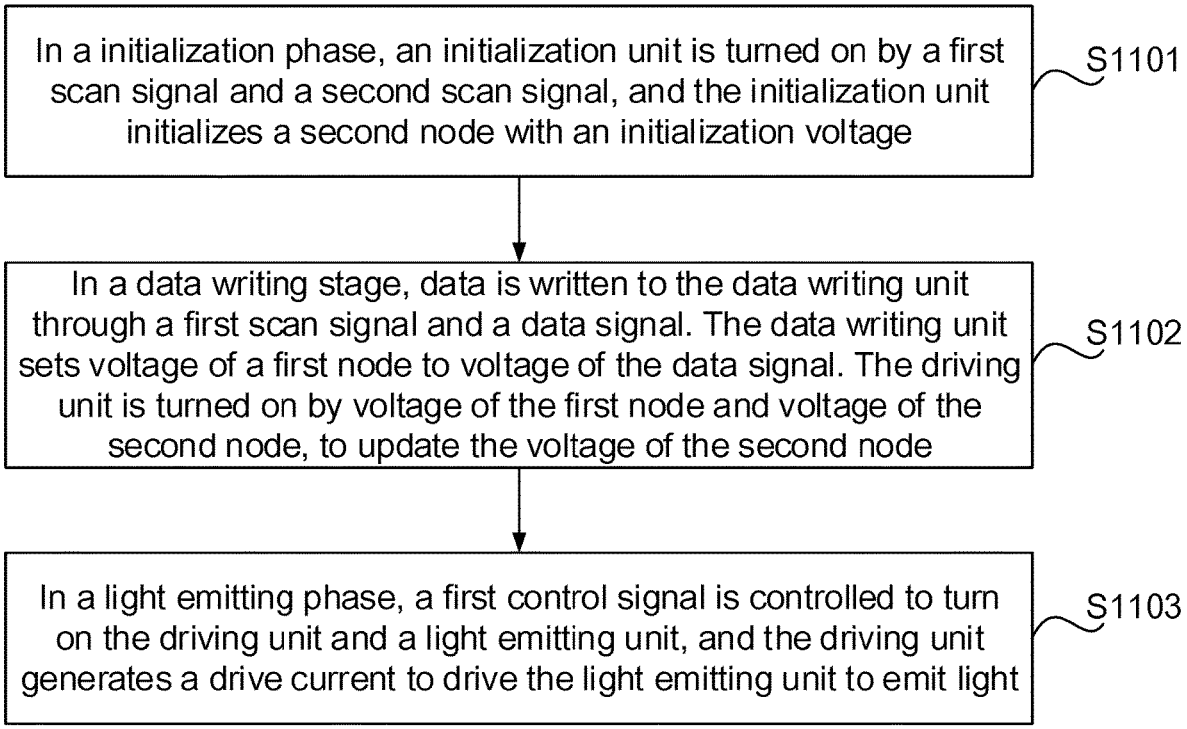
FIG. 11 is a flow diagram of a pixel circuit driving method according to an embodiment of the present disclosure.

Based on the same technical principle, some embodiments of the present disclosure further provide a pixel circuit driving method for driving the abovementioned pixel circuit. FIG. 11 illustrates the flow of a pixel circuit driving method according to an embodiment of the present disclosure, including the following steps.

Step S1101, in the initialization stage, the initialization unit is turned on by the first scan signal and the second scan signal. The initialization unit initializes the second node with the initialization voltage.

Step S1102, in the data writing stage, data is written to the data writing unit in response to the first scan signal and the data signal. The data writing unit sets the voltage of the first node to the voltage of the data signal. The driving unit is turned on in response to the voltage at the first node and the second node so as to update the voltage of the second node.

Step S1103, in the light emission stage, the first control signal is configured to turn on the driving unit and the light emitting unit. The driving unit generates a driving current to drive the light emitting unit to emit light. The value of the driving current depends on the voltage of the second node, the external power supply, and the threshold voltage of the drive transistor in the driving unit.

Figure 12:
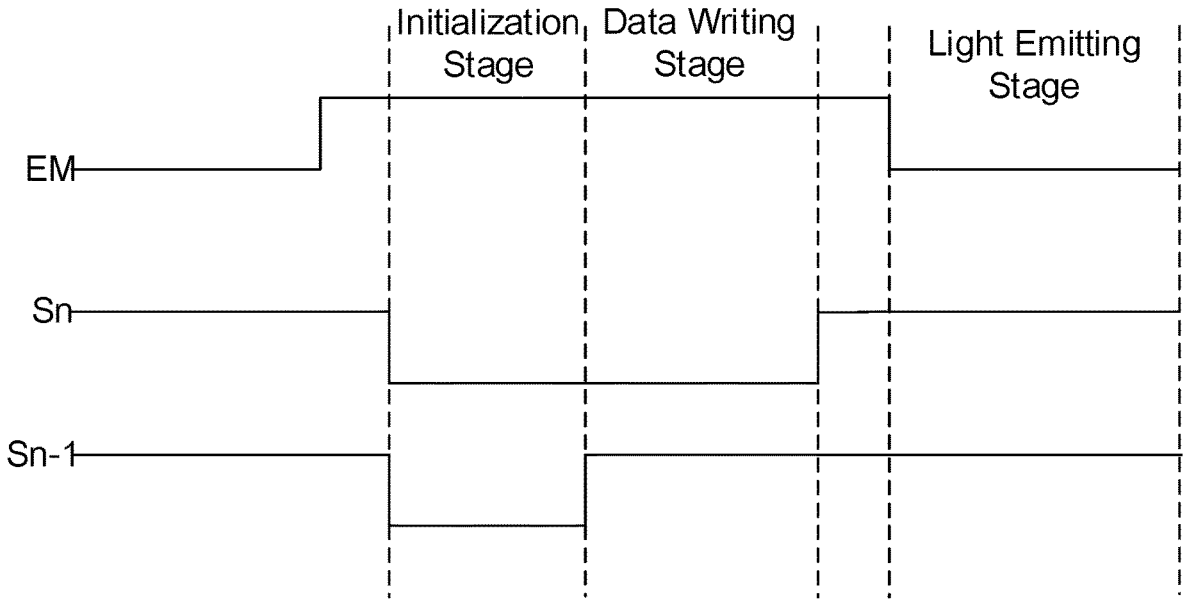
FIG. 12 is a driving signal diagram of an embodiment according to the present disclosure.

Specifically, the initialization stage further includes: the initialization unit initializing the OLEDs of the light emitting unit with the initialization voltage. FIG. 12 is a schematic diagram of driving signals according to an embodiment of the present disclosure, showing driving signals corresponding to the abovementioned pixel circuit driving method. The driving signals disclosed in FIG. 12 include a first scan signal Sn, a second scan signal Sn−1 and the first control signal EM. FIG. 12 further discloses the sequence of the first scan signal Sn, the second scan signal Sn−1, and the first control signal EM when the transistors of the data writing unit, driving unit, light emitting unit, and initialization unit in the driving circuit are positive channel metal oxide semiconductor transistors (PMOS).

In the initialization phase, as shown in FIG. 12, as the first scan signal Sn and the second scan signal Sn−1 are at low level, the initialization unit is turned on. The initialization unit initializes the second node N2 with the initialization voltage. Meanwhile, the initialization unit initializes the OLED EL4 of the light emitting unit with the initialization voltage VINI. The first control signal EM is at high level, to turn off the light emitting unit.

In the data writing stage, as shown in FIG. 12, as the first scan signal Sn is at low level and the second scan signal Sn−1 and the first control signal EM are at high level, the data writing unit and the driving unit are turned on, and the initialization unit and light emitting unit are turned off. Data is written to the data writing unit in response to the first scan signal Sn and the data signal data. The data writing unit sets the voltage of the first node N1 to the voltage of the data signal data. The driving unit is turned on in response to the voltage of the first node N1 and the second node N2, updating the voltage of the second node N2.

In the light emitting phase, as shown in FIG. 12, the first control signal EM is at low level, the first scan signal Sn and the second scan signal Sn−1 are at high level, turning on the driving unit and the light emitting unit and turning off the data writing unit and the initialization unit. The driving unit generates the driving current to drive the light emitting unit to emit light. The driving current depends on the voltage of the second node N2, the external power supply ELVDD, and the threshold voltage of the driving transistor T5 of the driving unit. Due to the second node being initialized by the initialization unit and the voltage of the second node compensated by the driving unit and the initialization unit, the initialization and voltage compensation of the second node are simultaneously performed through the initialization unit, thereby reducing the storage capacitor leakage paths, and thus the storage capacitor leakage during the light emitting stage, and improving the quality of the displayed image.

Some specific implementations using PMOS are described as follows. It should be noted that modifications to such implementation should fall within the scope of the present disclosure, such as the circuits using NMOS or CMOS. Instead of enumerating all possible modifications, this present disclosure intends to introduce some pixel circuits in alignment with the technical proposals disclosed in the embodiments of the present disclosure.

Example 1

Figure 13:
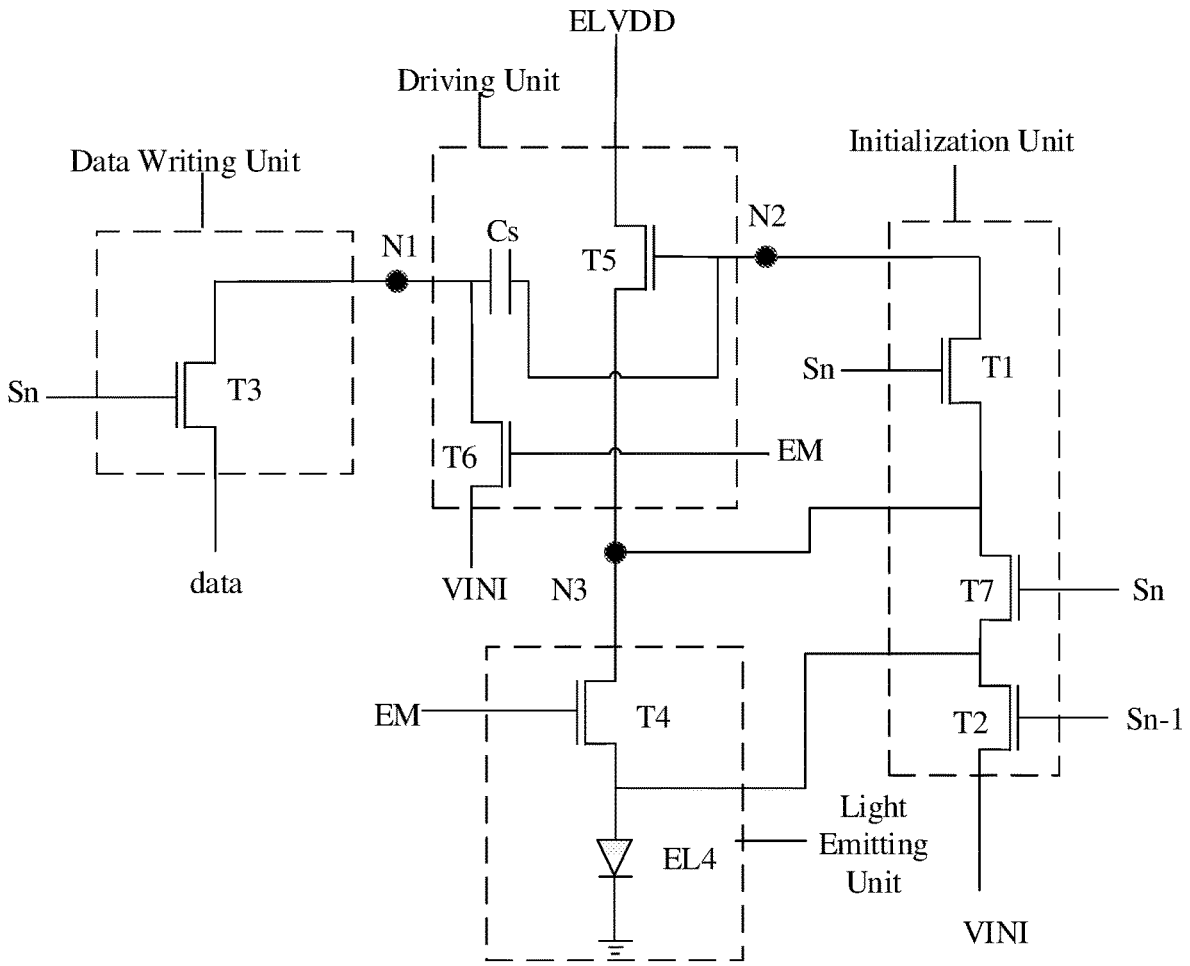
FIG. 13 is a practicable implementation of a pixel circuit according to an embodiment of the present disclosure.

FIG. 13 shows one possible implementation of a pixel circuit according to an embodiment of the present disclosure. As shown in FIG. 13, the pixel circuit includes: a data writing unit, a driving unit, a light emitting unit, and an initialization unit.

The initialization unit includes a first initialization transistor T1, a second initialization transistor T2, and a third initialization transistor T7. The first electrode of the first initialization transistor T1 is electrically coupled to the driving unit through a second node N2, and the second electrode of the first initialization transistor T1 is electrically coupled to the first electrode of the third initialization transistor T7, the driving unit and the light emitting unit through the third node N3, respectively. The gate electrode of the first initialization transistor T1 is configured to receive the external first scan signal Sn. The second electrode of the third initialization transistor T7 is electrically coupled to the first electrode of the second initialization transistor T2. The gate electrode of the third initialization transistor T7 is configured to receive a first scan signal Sn. The second electrode of the second initialization transistor T2 is configured to receive an external initialization voltage VINI, and the gate electrode of the second initialization transistor T2 is configured to receive an external second scan signal Sn−1.

The data writing unit includes a data writing transistor T3. The first electrode of the data writing transistor T3 is electrically coupled to the driving unit through a first node N1. The second electrode of the data writing unit T3 is configured to receive the external data signal data. The gate electrode of the data writing transistor T3 is configured to receive the first scan signal Sn.

The light emitting unit includes a light emitting control transistor T4 and an OLED EL4. The first electrode of the light emitting control transistor T4 is electrically coupled to the driving unit and the initialization unit through a third node N3. The second electrode of the light emitting control transistor T4 is electrically coupled to the OLED EL4. The gate electrode of the control transistor T4 is configured to receive the external first control signal EM.

The driving unit includes a storage capacitor Cs, a driving transistor T5 and a switching transistor T6. The storage capacitor Cs is located between the first node N1 and the second node N2. The first electrode of the driving transistor T5 is coupled to an external power supply ELVDD, the gate electrode of the driving transistor T5 is electrically coupled to the initialization unit and the storage capacitor Cs through the second node N2, and the second electrode of the driving transistor T5 is electrically coupled to the light emitting unit and the initialization unit through the third node N3, respectively. The first electrode of the switching transistor T6 is electrically coupled to the data writing unit and the storage capacitor Cs through the first node N1, the second electrode of the switching transistor T6 is configured to receive the initialization voltage VINI, and the gate electrode of the switching transistor T6 is configured to receive the first control signal EM.

According to the driving signal shown in FIG. 12, the driving method of the pixel circuit shown in FIG. 13 includes the following stages.

In the initialization stage, the first scan signal Sn and the second scan signal Sn−1 are at low level, turning on the first initialization transistor T1, the second initialization transistor T2, and the third initialization transistor T7, and setting the voltage of the second node T2 to the initialization voltage VINI, so as to initialize the second node T2. The first control signal EM is at high level, turning off the light emitting unit.

In the data writing stage, the first scan signal Sn is at a low level, causing the data writing transistor T3 to be turned on, and setting the voltage of the first node N1 to the voltage of the data signal data, i.e. $V_{N1}=V_{data}$. The first scan signal Sn is at low level, the second scan signal Sn−1 is at high level, so that the first initialization transistor T1 is turned on, and the second initialization transistor T2 is turned off. Since the first initialization transistor T1 is turned on, the driving transistor T5 operates in the saturation region, and the driving transistor T5 writes the external power supply ELVDD to the second node N2 through the first initialization transistor T1. When the voltage of the second node N2 rises up to (ELVDD+$V_{thT5}$) the driving transistor T5 is turned off so as to compensate the voltage at the second node N2.

In the light emission stage, the first scan signal Sn and the second scan signal Sn−1 are at high level, turning off the first initialization transistor T1, the second initialization transistor T2, and the third initialization transistor T7, thereby reducing the leakage of the storage capacitor Cs. The first control signal EM is at low level, so that the switching transistor T6 and the light emitting control transistor T4 are turned on, and the driving unit generates a driving current to drive the OLED EL4 to emit light. The driving current depends on the voltage of the second node N2, the external power supply ELVDD and the threshold voltage of the driving transistor T5 in the driving unit. Wherein, the voltage of the first node N1 is set to the initialization voltage, i.e. $V_{N1}$=VINI. Given the storage capacitor Cs is located between the first node N1 and the second node N2, in order to ensure the voltage balance between two ends of the storage capacitor Cs, the second node N2 is set to (ELVDD+$V_{thT5}$+VINI−$V_{data}$) according to the voltage of the first node N1. It can be seen from Equation 1 that, in this instance, the magnitude of the driving current flowing through the light emitting unit EL4 is as shown in Equation 2.

$$I_{ELA} = \frac{1}{2}\mu C_{OX}\frac{W}{L}(VINI - V_{data})^2 \quad \text{(Equation 2)}$$

wherein, VINI refers to the initialization voltage, and $V_{data}$ refers to the voltage of the data signal. Since the driving current flowing through the light emitting unit EL4, in this instance, is independent of the threshold voltage of the driving transistor T5, the OLED is no longer influenced by the driving transistor threshold current. Also, the initialization path and the voltage compensation path of the second node are merged into one path, therefore the leakage paths of Cs during the light emission stage are reduced, and the quality of the displayed image is improved.

Figure 14:
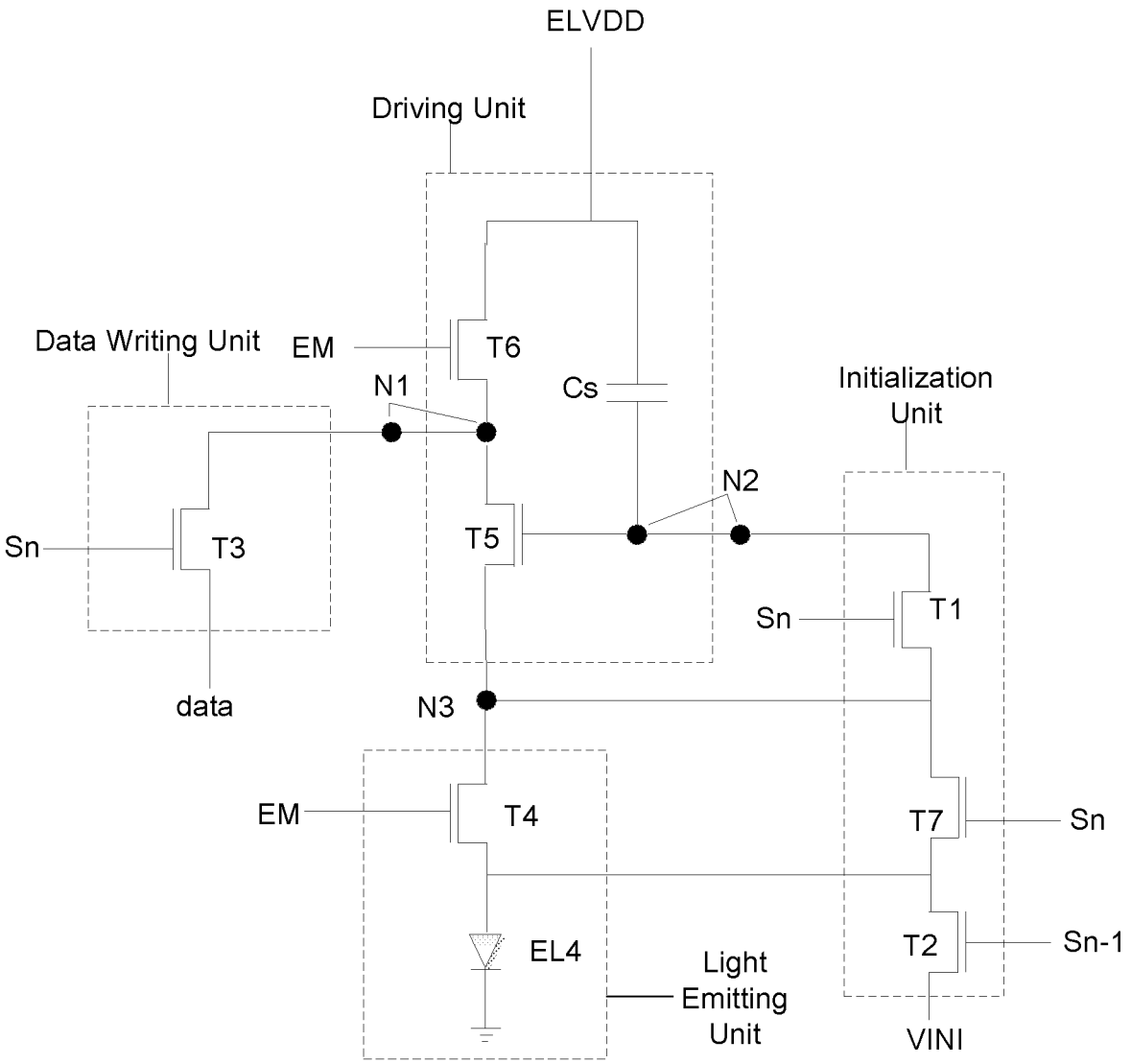
FIG. 14 is a practicable implementation of a pixel circuit according to one embodiment of the present disclosure.

FIG. 14 shows another possible implementation of the pixel circuit according to an embodiment of the present disclosure. As shown in FIG. 14, the pixel circuit includes: a data writing unit, a driving unit, a light emitting unit, and an initialization unit.

The initialization unit includes a first initialization transistor T1, a second initialization transistor T2, and a third initialization transistor T7. The first electrode of the first initialization transistor T1 is electrically coupled to the driving unit through the second node N2, and the second electrode of the first initialization transistor T1 is respectively electrically coupled to the first electrode of the third initialization transistor T7, the driving unit and the light emitting unit through the third node N3. The gate electrode of the first initialization transistor T1 is configured to receive the first scan signal Sn. The second electrode of the third initialization transistor T7 is electrically coupled to the first electrode of the second initialization transistor T2, and the gate electrode of the third initialization transistor T7 is configured to receive the first scan signal Sn. The second electrode of the second initialization transistor T2 is configured to receive the external initialization voltage VINI, and the gate electrode of the second initialization transistor T2 is configured to receive the second scan signal Sn−1.

The data writing unit includes a data writing transistor T3. The first electrode of the data writing transistor T3 is electrically coupled to the driving unit through a first node N1. The gate electrode of the data writing transistor T3 is configured to receive the first scan signal Sn.

The light emitting unit includes a light emitting control transistor T4 and an OLED EL4. The first electrode of the light emitting control transistor T4 is electrically coupled to the driving unit and the initialization unit through a third node N3. The second electrode of the light emitting control transistor T4 is electrically coupled to the OLED EL4 and the initialization unit, the gate electrode of the light emission control transistor T4 is configured to receive a first control signal EM.

The driving unit includes a storage capacitor Cs, a driving transistor T5, and a switching transistor T6. One end of the storage capacitor Cs is coupled to an external power supply ELVDD. The other end of the storage capacitor Cs is electrically coupled to the initialization unit and the gate electrode of the driving transistor T5 through a second node N2. The first electrode of the driving transistor T5 is electrically coupled to the data writing unit and the second electrode of the switching transistor T6 through a first node N1, respectively. The second electrode of the driving transistor T5 is electrically coupled to the light emitting unit and the initialization unit through a third node N3. The first electrode of the switching transistor T6 is coupled to an external power supply ELVDD, and the gate electrode of the switching transistor T6 is configured to receive the first control signal EM.

According to the driving signal shown in FIG. 12, the driving method of the pixel circuit shown in FIG. 14 includes the following stages.

In the initialization stage, the first scan signal Sn and the second scan signal Sn−1 are at low level, turning on the first initialization transistor T1, the second initialization transistor T2, and the third initialization transistor T7, and setting the voltage of the second node T2 to the voltage VINI, so as to perform the initialization of the second node T2. The voltage of the OLED EL4 is set to the initialization voltage VINI to perform the initialization of the OLED EL4. The first control signal EM is at high level, turning off the light emitting unit.

In the data writing stage, the first scan signal Sn is at a low level, turning on the data writing transistor T3, and setting the voltage of the first node N1 to the voltage of the data signal data, i.e. $V_{N1}=V_{data}$. The first scan signal Sn is at low level, the second scan signal Sn−1 is at high level, so that the first initialization transistor T1 is turned on, and the second initialization transistor T2 is turned off Since the first initialization transistor T1 is turned on, the driving transistor T5 operates in the saturation region, and the driving transistor T5 writes the voltage $V_{data}$ of the first node N1 to the second node N2 through the first initialization transistor T1 until the voltage of the second node N2 reaches ($V_{data}$+$V_{thT5}$). The driving transistor T5 is then turned off to perform voltage compensation for the second node N2.

In the light emission phase, the first scan signal Sn and the second scan signal Sn−1 are at high level, turning off the first initialization transistor T the second initialization transistor T2, and the third initialization transistor T7, thereby reducing the leakage of the storage capacitor Cs. The first control signal EM is at low level, which turns on the switching transistor T6 and the light emitting control transistor T4, and the driving unit generates a driving current to drive the OLED EL4 to emit light. The driving current depends on the voltage of the second node N2, the external power supply ELVDD, and the threshold voltage of the driving transistor T5. Wherein the voltage of the first node N1 is set to be equal to the voltage of the external power supply, i.e. $V_{N1}$=ELVDD. The storage capacitor Cs maintains the voltage of the second node N2 at ($V_{data}$+$V_{thT5}$). It can be seen from Equation 1 that, in this instance, the magnitude of the driving current flowing through the light-emitting unit EL4 is shown in Equation 3.

$$I_{ELA} = \frac{1}{2}\mu C_{OX}\frac{W}{L}(V_{data} - ELVDD)^2 \quad \text{(Equation 3)}$$

wherein, $V_{data}$ refers to the voltage of the data signal, ELVDD refers to the voltage of the external power supply. Since the driving current flowing through the light emitting unit EL4, in this instance, is independent of the threshold voltage of the driving transistor, the OLED is not influenced by the threshold current of the driving transistor. Since the initialization path and the voltage compensation path of the second node are merged into one path, the storage capacitor leakage paths of Cs in the light-emitting stage are reduced, and the quality of the displayed image is improved. As the charge leakage of the storage capacitor (Cs) is reduced, size of the storage capacitor is reduced, thereby reducing the pixel size and increasing the maximum pixel per inch. In return, the writing speed of the pixel data to the storage capacitor further is increased, accommodating more rapid refresh rate. Due to the reduced charge leakage of the storage capacitor (Cs), the refresh rate can, in fact, be reduced by a certain amount without compromising the quality of the displayed image, which is of great significance for saving power consumption, especially for products to wear requiring low power consumption.

Figure 15:
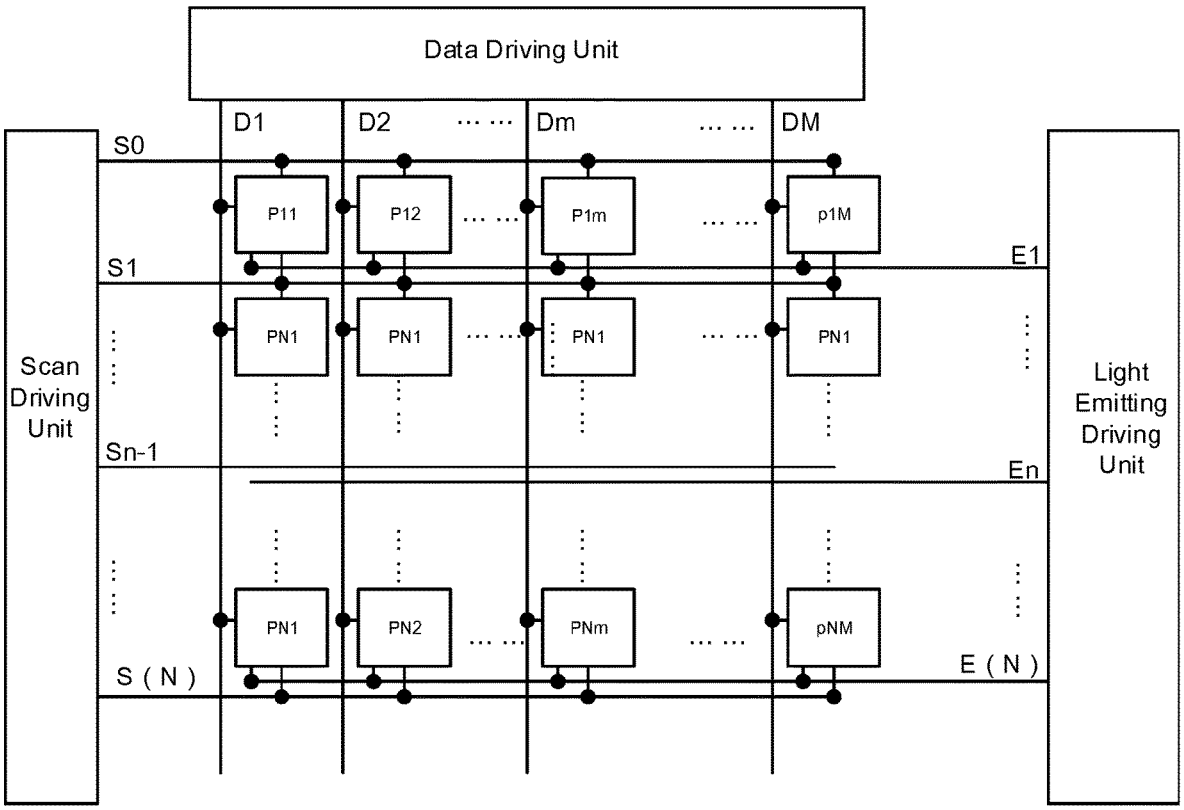
FIG. 15 is a schematic diagram of a display device according to one embodiment of the present disclosure.

Based on the same technical concept, an embodiment of the present disclosure further provides a display device, implementing the pixel circuit described in any of the abovementioned embodiments. FIG. 15 is a schematic diagram of a display according to an embodiment of the present disclosure, wherein, the display device includes an N×M pixel circuit array, and a scan driving unit generates scan signals S0, S1, S2 . . . SN, wherein Sn is the scan signal input to the $n_{th}$ row of pixels by the scan driving unit, n=1, 2, . . . N; the data driving unit generates a total of M data signals Data, including D1, D2 . . . DM, respectively, corresponding to M columns of pixels, where Dm is the data signal data of the $m_{th}$ column of pixels, m=1, 2, . . . M; the light emitting driving unit generates first control signals E1, E2 . . . EN, wherein En is the first control signals input to the pixels of the $n_{th}$ row of the light emitting driving unit, n=1, 2, . . . N.

Although some embodiments of the present disclosure have been described, those skilled in the art can make additional changes and modifications to these embodiments once they learn the basic inventive concept. Therefore, what is claimed is intended to be interpreted by the embodiments hereof and all changes and modifications that fall within the scope of the claims of the present disclosure.

It will be apparent to those skilled in the art that various modifications and variations can be made to the present disclosure without departing from the inventive spirit and scope of the present disclosure. If any modifications and variations of the present disclosure fall within the scope of the claims of the present disclosure or its equivalent, the present disclosure is intended to include those modifications and variations.

What is claimed is:

1. A pixel circuit comprising:

a data writing unit;

a driving unit, electrically coupled to the data writing unit through a first node;

an initialization unit, electrically coupled to the driving unit through a second node and a third node respectively, and a light emitting unit, electrically coupled to the driving unit through the third node;

wherein, the initialization unit is configured to receive an external first scan signal, an external second scan signal and an external initialization voltage; the initialization unit is configured to initialize the second node with the initialization voltage, in response to the first scan signal and the second scan signal;

the data writing unit is configured to receive an external data signal and the first scan signal; the data writing unit is configured to set voltage of the first node to voltage of the data signal in response to the first scan signal and the data signal, and update voltage of the second node through the driving unit and the initialization unit;

the driving unit is coupled to an external power supply and configured to receive a first control signal; the driving unit is configured to generate a driving current, in response to the first control signal, to drive the light emitting unit to emit light; the value of the driving current depends on the voltage of the second node, voltage of the external power supply and the threshold voltage of a driving transistor in the driving unit;

wherein the driving unit comprises:

a storage capacitor located between the first node and the second node;

the driving transistor, comprising a first electrode coupled to the external power supply, a second electrode electrically coupled to the light emitting unit and the initialization unit respectively through the third node, and a gate electrode electrically coupled to the initialization unit and the storage capacitor respectively through the second node;

a switching transistor, comprising a first electrode electrically coupled to the data writing unit and the storage capacitor respectively through the first node, a second electrode configured to receive the initialization voltage, and a gate electrode configured to receive the first control signal.

2. The pixel circuit according to claim 1, wherein the initialization unit comprises:

a first initialization transistor, comprising a first electrode electrically coupled to the driving unit through the second node, a second electrode electrically coupled to the driving unit and the light emitting unit respectively through the third node, and a gate electrode configured to receive the first scan signal;

a second initialization transistor, comprising a first electrode electrically coupled to the second electrode of the first initialization transistor through the third node, a second electrode configured to receive the initialization voltage, and a gate electrode configured to receive the second scan signal;

wherein, the first initialization transistor and the second initialization transistor are configured to set the voltage of the second node to the initialization voltage during an initialization stage;

the first initialization transistor is further configured to update the voltage of the second node through the driving unit during a data writing stage.

3. The pixel circuit according to claim 2, wherein the data writing unit comprises a data writing transistor having a first electrode electrically coupled to the driving unit through the first node, a second electrode configured to receive the data signal and a gate electrode configured to receive the first scan signal.

4. The pixel circuit according to claim 2, wherein the light emitting unit comprises:

a light emission control transistor, comprising a first electrode electrically coupled to the driving unit and the initialization unit through the third node, a second electrode, and a gate electrode configured to receive the first control signal;

an OLED, electrically coupled to the second electrode of the light emission control transistor.

5. The pixel circuit according to claim 4, wherein the initialization unit is electrically coupled to the OLED, and is further configured to initialize the OLED with the initialization voltage, in response to the first scan signal and the second scan signal.

6. A pixel circuit driving method, applied to the pixel circuit according to claim 1, comprising:

in an initialization stage, turning on the initialization unit in response to the first scan signal and the second scan signal, and initializing the second node by the initialization unit with the initialization voltage;

in a data writing stage, writing data to the data writing unit in response to the first scan signal and the data signal; the data writing unit setting the voltage of the first node to the voltage of the data signal; turning on the driving unit in response to the voltage of the first node and the voltage of the second node, and updating the voltage of the second node;

in a light emission stage, turning on the driving unit and the light emitting unit in response to the first control signal; the driving unit generating a driving current to drive the light emitting unit to emit light; wherein the value of the driving current depends on the voltage of the second node, the voltage of the external power supply and the threshold voltage of the driving transistor in the driving unit.

7. The method according to claim 6, wherein in the initialization stage, further comprises the initialization unit initializing the OLED of the light emitting unit with an initialization voltage.

8. A display device, comprising the pixel circuit according to claim 1.

* * * * *